United States Patent [19]

Efferding

[11] Patent Number: 4,896,046

[45] Date of Patent: Jan. 23, 1990

[54] FUEL ROD SHIPPING CASK HAVING PERIPHERAL FINS

[75] Inventor: Larry E. Efferding, Pensacola, Fla.

[73] Assignee: Westinghouse Electric Corp., Pittsburgh, Pa.

[21] Appl. No.: 189,208

[22] Filed: May 24, 1988

[51] Int. Cl.[4] ..... G21F 5/00

[52] U.S. Cl. ..... 250/507.1

[58] Field of Search ..... 376/272; 250/506.1, 250/507.1

[56] References Cited

U.S. PATENT DOCUMENTS

| | | | |
|---|---|---|---|
| 4,339,411 | 7/1982 | Knackstedt et al. | 376/272 |
| 4,666,659 | 5/1987 | Lusk et al. | 376/272 |
| 4,711,758 | 12/1987 | Machado et al. | 376/272 |
| 4,752,437 | 6/1988 | Ito et al. | 376/272 |
| 4,781,883 | 11/1988 | Daugherty et al. | 376/272 |
| 4,800,283 | 1/1989 | Efferding | 376/272 |

FOREIGN PATENT DOCUMENTS

| | | | |
|---|---|---|---|
| 0087350 | 8/1983 | European Pat. Off. | 250/506.1 |
| 2817193 | 10/1979 | Fed. Rep. of Germany | 250/506.1 |
| 2166680 | 5/1987 | United Kingdom . | |

OTHER PUBLICATIONS

Topical Safety Analysis Report for the Westinghouse MC-10 Cask for an Independent Spent Fuel Storage Installation . . . dated Mar, 1987.

Institute of Nuclear Materials Management Spent Fuel Storage Seminar, dated Jan. 20-22, 1988.

*Primary Examiner*—Daniel Wasil

[57] ABSTRACT

A shipping cask for transporting radioactive material is disclosed herein which comprises an inner vessel having metallic, heat conducting walls, a plurality of heat conductive, mutually parallel ribs, wherein the inside edge of each is connected to the outside surface of the heat conducting wall of the inner vessel, a layer of neutron absorbing cement disposed over the exterior of the inner vessel and between the mutually parallel ribs, and a plurality of flat circumferentially disposed fin members, each of which has two opposing and mutually parallel edges that are welded to the outer edges of two adjacent ribs. The flat circumferentially disposed fin members dissipate heat conducted through the ribs generated by radioactive material within the inner vessel, and further serve both to support and protect the brittle layer of cement, as well as to provide a watertight barrier thereover so that the cask may be submerged or otherwise exposed to water without absorbing any significant amounts.

25 Claims, 7 Drawing Sheets

FUEL ROD SHIPPING CASK HAVING PERIPHERAL FINS

BACKGROUND OF THE INVENTION

This invention generally relates to casks for transporting nuclear materials to or from nuclear power plant facilities and is specifically concerned with a cask having circumferentially oriented fins for both dissipating heat generated by spent fuel rods contained within the cask and for providing a protective, watertight barrier around a layer of neutron-absorbing cement disposed within the wall of the cask.

Casks for shipping fuel rods to and from nuclear power plants are known in the prior art. Such casks generally include a transportable steel vessel that is cylindrical in shape, and a basket structure that is receivable within the steel vessel having an array of cells for holding rectangular storage containers. Each of these storage containers, in turn, may hold either a fuel rod assembly, or a spent fuel canister wherein fuel rods are consolidated in a dense, triangular-pitch arrangement. Such transportable casks may be secured onto the trailer of a tractor-trailer, and are typically used to ship spent fuel rods from a nuclear power plant to a permanent waste isolation site or a reprocessing facility in as safe a manner as possible. At the present time, relatively few of such shipping casks have been manufactured and used since most of the utility companies that own nuclear facilities have been able to store the spent fuel rods in the spent-fuel pools that were initially built into such reactor facilities. However, the availability of such on-site storage space is steadily diminishing as an increasing number of fuel assemblies are being loaded into the spent-fuel pools of such facilities everyday. The recognition of the need for additional storage facilities has induced the Congress of the United States to pass an act obligating the Nuclear Regulatory Commissioner (NRC) to move the spent fuel assemblies from the on-site storage facilities of nuclear power plants to a federally operated nuclear waste disposal facility starting in 1998. Thus the need for such casks is about to increase substantially.

While the transportation vessels of the prior art are generally capable of safely transporting spent fuel to a final destination, there is considerable room for improvement. But, before these potential areas of improvement can be fully appreciated, some understanding of the objectives that these casks must meet is necessary.

In order to be practical, a cask for transporting radioactive material by truck must meet at least five basic criteria. First, the walls of the cask must be capable of effectively shielding both the gamma and neutron radiation emitted by its payload so that the total amount of radiation emitted from the surface of the cask is at a level low enough to be safely handled. In fact, U.S. Nuclear Regulatory Commission (NRC) regulations specify that the surface radiation of any such cask may be no greater than 200 millirems at any given point, and that the radiation emitted by the cask be no greater than 10 millirems at a distance of two meters from any vehicle that the cask is mounted on. Secondly, the cask must be capable of withstanding the mechanical shock of a magnitude commensurate with that of a vehicular accident. In this regard, it is not enough that the walls of the cask continue to contain the radioactive material after such a mechanical shock. They must further maintain water tightness at all points so that water will not have an opportunity to leak into the interior of the cask and thermalize the neutrons being emitted by the spent fuel rods or other materials contained therein. Thirdly, the basket structure within the cask must be capable of withstanding the forces applied to its perimeter by the inner cask walls in the event of an accident without any significant distortion of its individual, waste-containing cells. If these cells do undergo significant amounts of distortion, the effectiveness of the neutron "traps" installed between these cells could be jeopardized, which could in turn result in a criticality condition within the cask. Fourthly, the cask must be immersible in water without the incursion of any outside water into the interior of the walls of the cask, and must further be completely drainable. The reason for this requirement is that such casks are often loaded and unloaded in the spend-fuel pools of nuclear facilities to reduce exposure of the operating personnel to potentially harmful radiation The water in such pools typically contains dissolved radionucleides, which, if allowed to seep into the crevices in the cask, or to deposit themselves into micropores on the cask surface, might prove difficult if not impossible to remove. The deposition of such radionucleides in the crevices and surface pores of the casks could well raise the surface radiation of the cask beyond DOT limits, thereby rendering the cask useless. Finally, the cask must be capable of effectively rejecting the heat of decay generated by the radioactive materials within it. If no effective heat rejection mechanism exists within the cask, the temperature within the cask could become high enough to generate dangerous levels of pressure.

Unfortunately, the simultaneous achievement of these five criteria is difficult, as the materials and mechanisms which implement one or the other criteria are often at cross purposes with one another. For example, the use of radially-projecting fins provides very good heat dissipation characteristics, but reduces the cask's ability to withstand large mechanical shocks and still maintain wall integrity. One of the best and most economical neutron shielding materials known is high-hydrogen cement. But, such cement is brittle, and generally incapable of maintaining integrity if exposed to the shattering forces of an accident condition. Lead, depleted uranium, and Boro-silicon® are also well known, effective gamma shielding materials. However, none of these materials has sufficient mechanical strength to withstand an accident condition alone. Moreover, none of these materials a is good heat conductor, and none of these materials is particularly easy to join to a structurally strong metal in a secure, integral fashion by welding or by any other known means in view of the large differences in their mechanical and metallurgical properties. While stainless steel has good structural and corrosion resistant properties, it is not a particularly good heat transfer medium, and is expensive. Additionally, the applicant has observed that the surface of stainless steel contains micropores that are capable of capturing both dissolved radionucleide and radioactive dust. Finally, while carbon steel is a good and inexpensive structural material having better head transfer properties than stainless steel, it is apt to corrode when exposed to water.

Clearly, what is needed is a transportation cask which reasonably fulfills each of the five necessary criteria in a design which is relatively easy and inexpensive to fabricate.

SUMMARY OF THE INVENTION

The improved shipping cask of the invention fulfills each of the five aforementioned criteria through a design which is simple yet effective. Generally, the shipping cask of the invention comprises an inner vessel having metallic, heat conducting walls which are preferably formed from low alloy steel, a plurality of heat conductive, mutually parallel ribs formed from carbon steel, wherein the inside edge of each rib is welded along the outside surface of the heat conducting wall of the vessel, a layer radiation absorbing, cementitious material disposed over the exterior of the heat conducting wall of the inner vessel and between the mutually parallel ribs, and a plurality of flat circumferentially disposed fin members also formed from carbon steel, each of which has two opposing and mutually parallel edges that are connected to the outer edges of two adjacent ribs. The circumferentially disposed fin members advantageously function both to dissipate any heat generated within the inner vessel from radioactive material contained therein, as well as to support and to provide a watertight barrier around the layer of cementitious material.

The shipping cask may further include a removable basket assembly that is insertable into and withdrawable from the interior of the inner vessel. The basket assembly includes an array of inner connected cells, each of which is capable of containing a selected volume of radioactive waste. In the preferred embodiment, the cell structure of the basket assembly is formed from two sets of parallel stainless steel plates which are orthogonally disposed with respect to one another and are inner fitted in "egg crate" fashion, whereby the periphery of the basket assembly is defined by the corners of the outer cells.

To help prevent the cells from deforming in the event that the cask is subjected to an intense mechanical shock, the basket assembly further includes angular formers around its periphery. These formers may be spaced apart so as not to interfere with the convective and radiative transfer of heat from the radioactive material in the cell structure of the basket to the wall of the inner vessel. In the preferred embodiment, the total area of the spaced apart formers is no more than about 20 percent of the total area of the outer periphery of the basket assembly. Each of the formers may be formed from a plurality of plates arranged in tandem around the circumference of the basket assembly wherein the edges of each plate are connected to the corners of two adjacent cells.

To further increase the resistance of the cell structure of the basket assembly to deformation in the event that the cask is subjected to an intense mechanical shock, the periphery of the basket assembly includes a plurality of uniformly spaced, discrete contact surfaces for uniformly distributing shock forces which may occur between the outer periphery of the basket assembly and the inside surface of the inner vessel. In the preferred embodiment, these discrete contact surfaces conform to the corners of the peripherially located cells of the basket assembly.

The fabrication of the inner vessel from low alloy steel, and the ribs and the fin members from carbon steel allows the structural components of the cask to all be easily welded together. To prevent surface corrosion and the lodgment either dissolved radionucleides or radioactive dust in the pores of the metal forming the circumferential fins, the outer surface of the fins may include an anti-corrosive coating. In the preferred embodiment, this coating includes a first layer of zinc-containing primer, a second layer of epoxy polyamide, and a third layer of polyuretane.

BRIEF DESCRIPTION OF THE SEVERAL FIGURES

DETAILED DESCRIPTION OF THE PREFERRED EMBODIMENT

General Overview of the Structure and Function of the Invention

Figure 1:
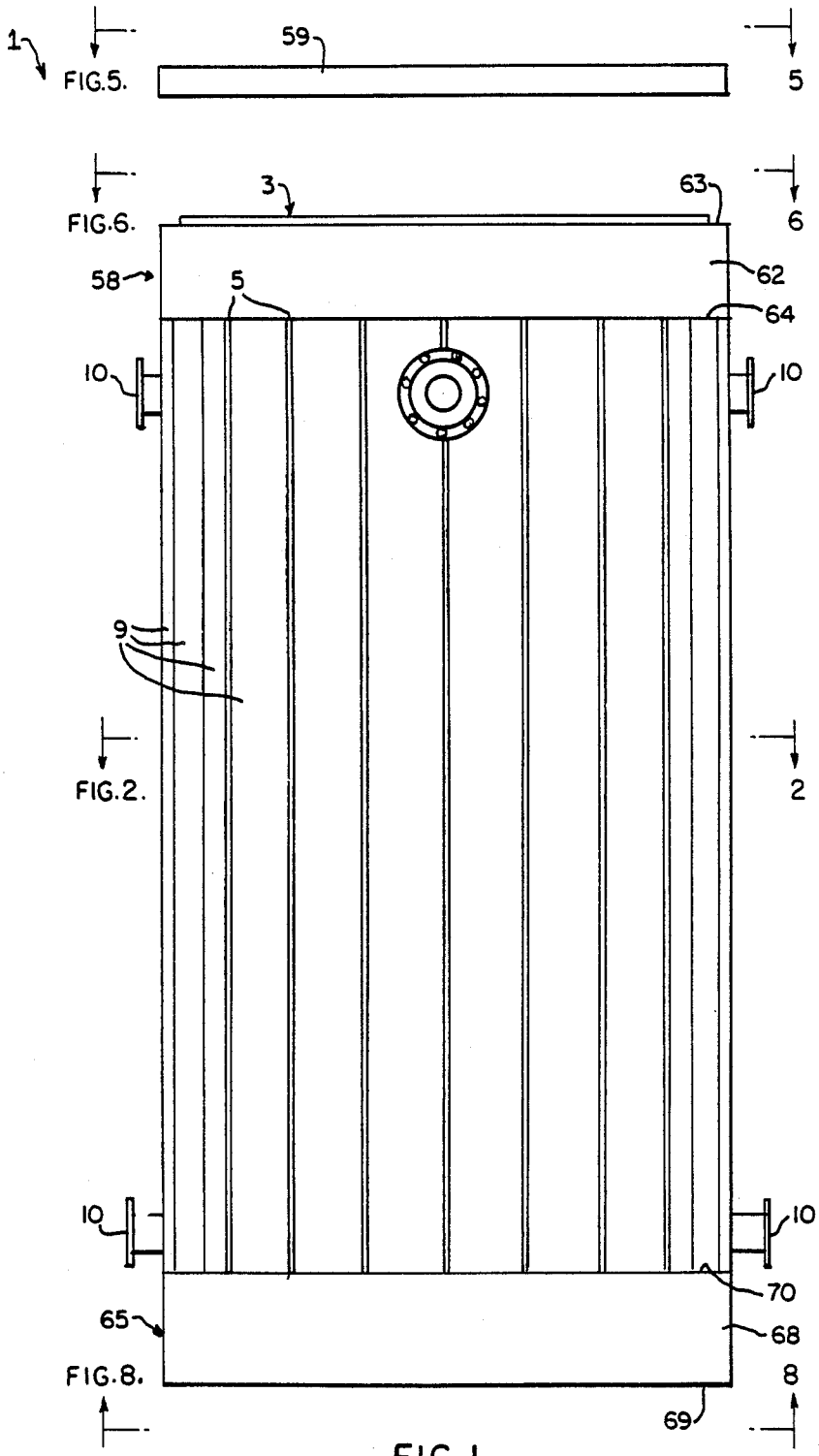
FIG. 1 is a side view of the transportation cask of the invention, showing the outer closure lid suspended over the top thereof.
Figure 2:
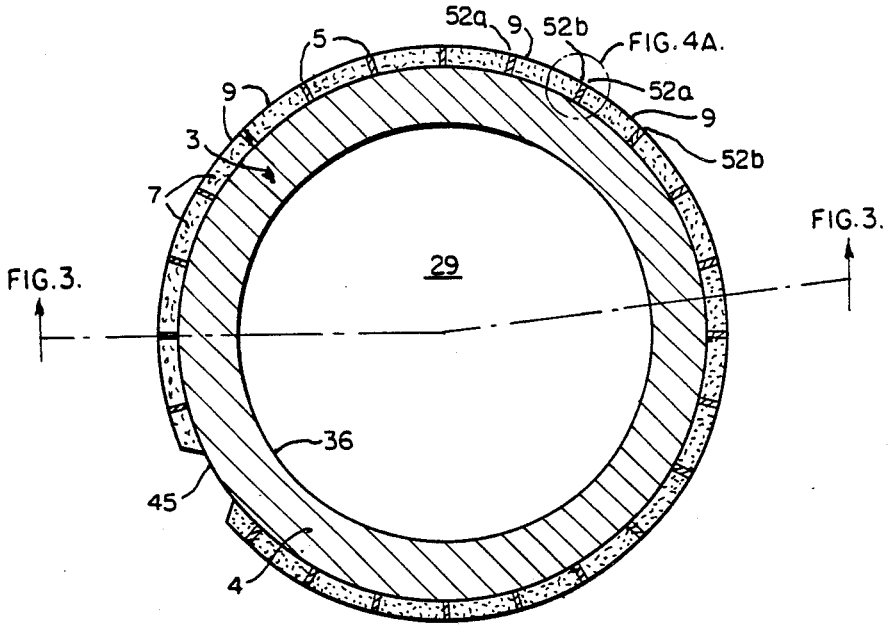
FIG. 2 is a cross-sectional view of the cask illustrated in FIG. 1 along the line 2—2 with part of the fins and layer of cement broken away for clarity.
Figure 3:
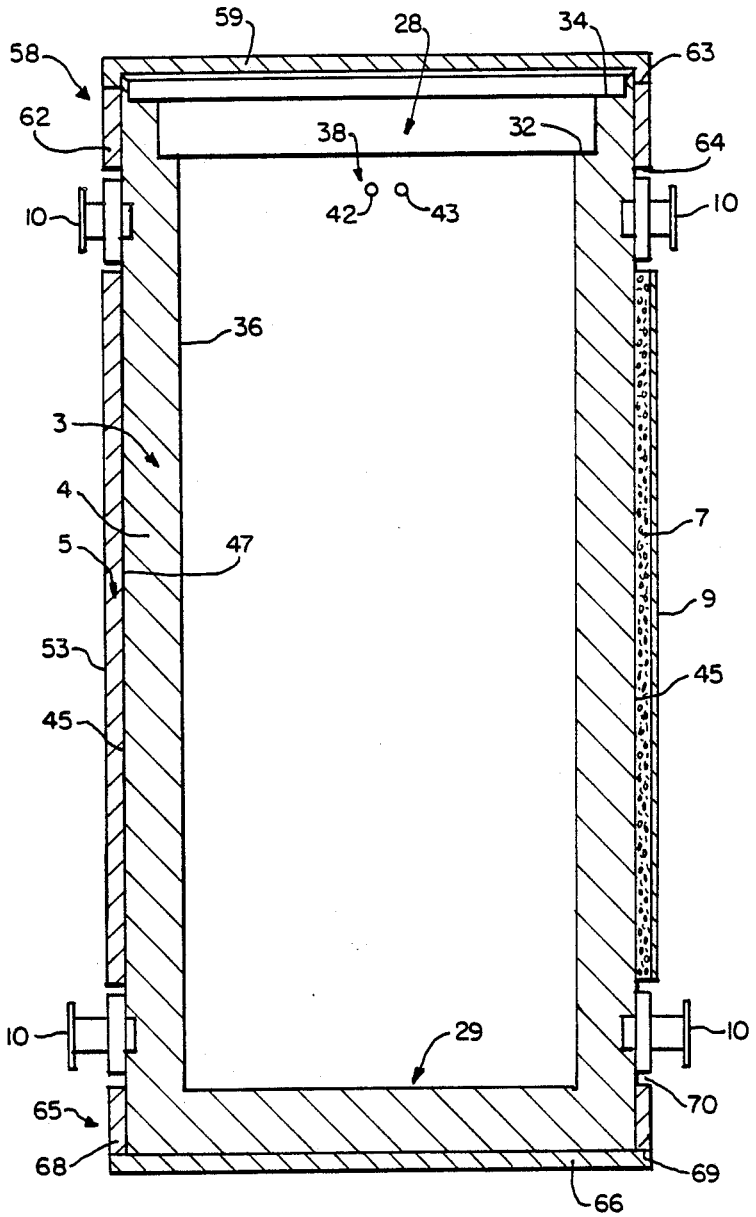
FIG. 3 is a cross-sectional side view of the cask along the line 3—3 in FIG. 2 with the basket assembly removed for clarity.

With reference now to FIGS. 1, 2 and 3 wherein like numerals designate like components throughout all of the several figures, the shipping cask 1 of the invention generally comprises an elongated cylindrical inner vessel 3 having a plurality of uniformly spaced and radially oriented ribs 5 welded along its longitudinal axis. A layer of neutron-absorbing cement 7 is applied over the outside surface of the vessel 3 between the uniformly spaced ribs 5. In the preferred embodiment, neutron-absorbing cement layer 7 is formed from a cement having a high percentage content of atomic hydrogen.

Figure 4B:
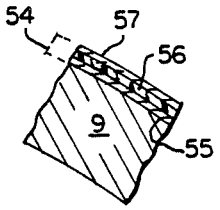
FIG. 4B is an enlarged view of the area circled in FIG. 4A showing the layers of the protective coating applied to the exterior of the cask.
Figure 4A:
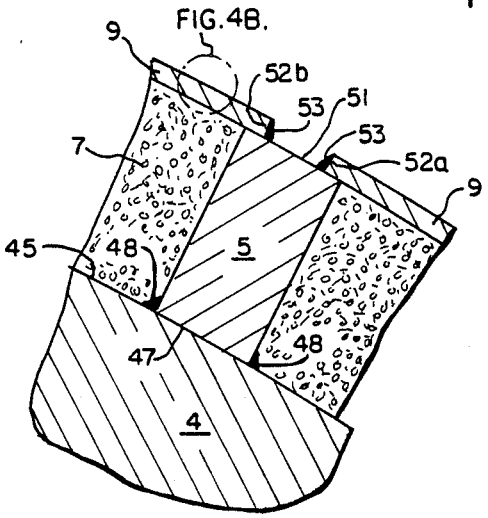
FIG. 4A is an enlarged view of the area circled in FIG. 3, showing the manner in which the fins are attached to the ribs.

As is best seen in FIGS. 2 and 4A, the exterior of the cask 1 is formed by a plurality of plate-like circumferential fins 9. Each of the lengthwise edges of the fins 9 is welded along the outer edge of one of the ribs 5 to form a secure and watertight joint between the edge of each fin and the outer edge of its particular rib 5. In the preferred embodiment, each of the fins 9 is an elongated, rectangular plate of carbon steel approximately 0.25 inches thick. The fins 9 advantageously perform three functions. First, they provide an effective means for dissipating heat transferred to them through the ribs 5. Secondly, they provide a strong mechanical barrier which protects the layer of cement from fracture, and retains and supports this layer in the event of an accident condition. Third, these fins provide a waterproof barrier around the layer of cement that prevents it from absorbing dissolved radionucleides when the cask is lowered into a spent fuel pool. In the preferred mode of fabricating the cask 1, the fins 9 are welded into the position illustrated in FIG. 2 and the neutronabsorbing cement 7 is poured into the spaces between the outer surface of the vessel 3 and the inner surface of the fins 9. Such a mode of manufacturing has the advantage of providing a "leak-test" for the welds securing the edges of the fins 9 along the outer edges of the ribs 5. Any leaking of water and cement along the outside surface of the cask 1 after the neutronabsorbing cement 7 has been poured informs the manufacturer of the necessity of removing the cement in the affected areas, and rewelding the joints between the fins 9 and ribs 5 into a watertight joint.

Figure 9A:
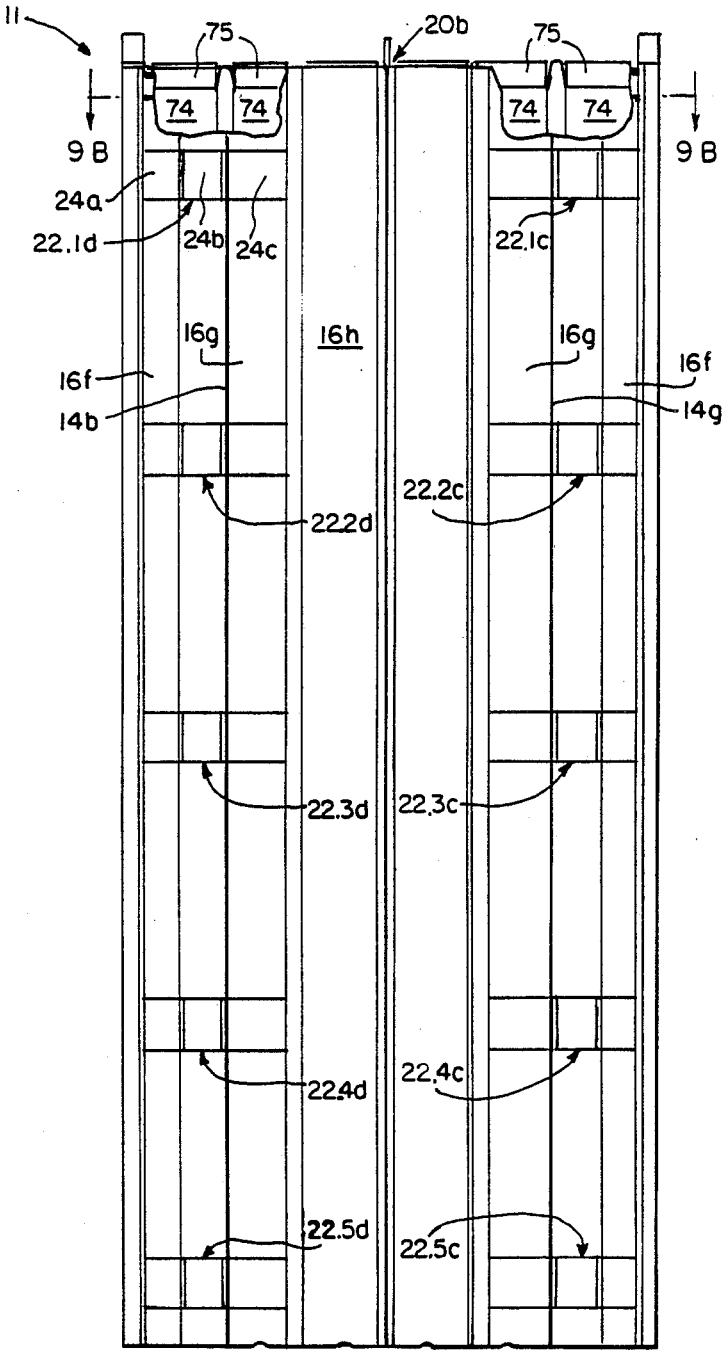
FIG. 9A is a side view of the basket assembly of the cask with part of the peripheral wall broken away to expose the rectangular canisters disposed within the cells of the assembly.
Figure 9B:
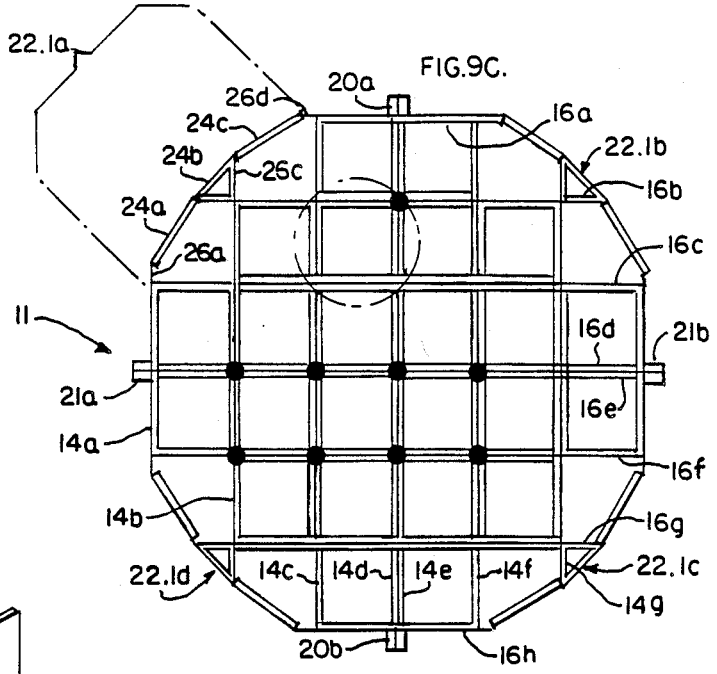
FIG. 9B is a plan view of the basket assembly illustrated in FIG. 9A.
Figure 9C:
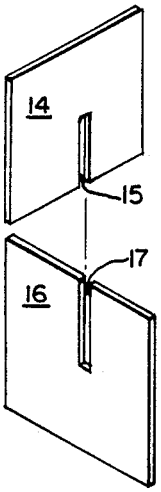
FIG. 9C illustrates the manner in which the two sets of parallel plates that form the basket assembly interfit with one another.

With reference now to FIGS. 6, 9A, 9B and 9C, the cask 1 further includes a basket assembly 11 which is freely insertable into and withdrawable from the interior of the inner vessel 3. The basket assembly 11 is formed from two sets of parallel plates 14*a*–14*h* and 16*a*–16*h*. Each of these sets of plates 14*a*–14*h* and 16*a*–16*h* includes slots 15, 17 which interfit as is best seen in FIG. 9C to form an "egg crate" of individual square cells 18*a*–18*x*. In the preferred embodiment, each of the parallel plates 14*a*–*h* and 16*a*–*h* is formed from a solid sheet of stainless steel approximately 0.40 inches thick. Additionally, the two pairs of parallel plates 14*a*–*h* and 16*a*–*h* are secured to one another by welds which extend along the edges of their respective slots 15 and 17 throughout their entire lengths. Each of these sets of parallel plates 14*a*–14*h* and 16*a*–16*h* includes a central, closely-spaced pair of plates 14*d*, 14*e* and 16*d*, 16*e* as is best shown in FIG. 9B. The central location of these closely-spaced plate pairs 14*d*, 14*e* and 16*e*, 16*d* within the basket assembly 11 lends extra strength to the basket assembly 11 as a Whole. Each of these plate pairs terminate in plate pair ends 20*a*, 20*b* and 21*a*, 21*b* respectively. These plate pair ends 20*a*, 20*b* and 21*a*, 21*b* provide four uniformly-spaced contact surfaces between the periphery of the basket assembly 11 and the inner surface of the vessel 3. The provision of such contact surfaces is important not only for the uniform transfer of heat from the radioactive materials within the cells 18*a*–18*x* through the walls of the vessel 3, but further for the uniform absorption of impact forces between the basket assembly 11 and the inner wall of the vessel 3 should the cask 1 ever be subjected to an accident condition. Additionally, at least one of the plate pair ends 20*a*, 20*b*, 21*a*, 21*b* coacts with the plate retaining assembly 38*a* a disposed on the inner surface of the vessel 3 in a manner which will be described shortly which maintains the orientation of the basket assembly 11 within the vessel 3 should the vessel 3 be subjected to torque. As is best seen in FIGS. 9A and 9B, the basket assembly 11 is circumscribed by a plurality of angular formers 22.1*a*–22.5*a*, 22.1*b*–22.5*b*, 22.1*c*–21.5*c* and 22.1*d*–22.5*d*. As is best seen in FIG. 9B, each of the angular formers is formed from three strut plates 24*a*, 24*b*, and 24*c* arranged in tandem and welded along their edges to corners defined by plate overhangs 26*a*, 26*b*, 26*c* and 26*d*. In the preferred embodiment, each of the strut plates 74 is formed from stainless steel plate material approximately 0.40 inches thick. Such a material is advantageously weld-compatible with the stainless steel plates 14*a*–14*h* and 16*a*–16*h* used to form the basket assembly 11. As is best seen in FIG. 9A, the angular formers 21.1*a*–22.5*d* are preferably uniformly spaced along the longitudinal axis of the basket assembly 11. The total area of the angular formers 22.1*a*–21.5*d* relative to the total exterior area of the basket assembly 11 is only preferably about 20 percent. The use of such angular formers 22.1*a*–22.5*d* in the basket assembly 11 is advantageous in two major respects First, the multiple, shallow Corners that each of these formers provides over the plate overhangs 26*a*, 26*b*, 26*c* and 26*d* offers four, broad lines of contact between the outer surface of the basket assembly 11, and the inner surface of the vessel 3. These multiple areas of contact cooperate with the contact areas already provided by the ends 20*a*, 20*b* and 21*a*, 21*b* of plate pairs 14*d*, 14*e* and 16*d*, 16*e* to give an ample amount of contact surface between the exterior of the basket assembly 11 and the interior of the vessel 3 both for thermal conduction purposes and for the equilibration of any mechanical shock forces inadvertently applied to the exterior of the cask 1 as the result of an accident. Secondly, the relatively small (20 percent) area of the strut plates 24*a*, 24*b* and 24*c* in these formers 22.1*a*–22.5*d* relative to the area of the periphery of the basket assembly 11 as a whole provides very little interference with the conductive and radiative transfer of heat from the radioactive materials disposed within the basket 11 to the walls of the inner vessel 3.

SPECIFIC DESCRIPTION OF THE STRUCTURE AND FUNCTION OF THE INVENTION

With reference again to FIGS. 1, 2, and 3, the inner vessel 3 of the cask 1 is generally cylindrical in shape and has an open top end 28 and a closed bottom end 29. The top end 28 is circumscribed by both an inner annular shoulder 32 having uniformly spaced bolt holes 33 as well as by an outer annular shoulder 34 which likewise includes uniformly spaced bolt holes 35. The general purpose of the inner and outer annular shoulders 32, 34 is to receive a double-lidded closure assembly (not shown) which may be of the type described and claims in copending U.S. patent application Ser. No. 109,507, filed Oct. 19, 1987, by George V. B. Hall et al and assigned to the Westinghouse Electric Corporation.

Figure 7:
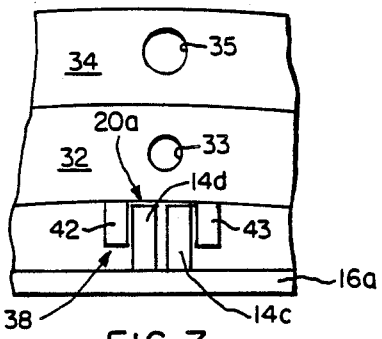
FIG. 7 is an enlarged view of the area circled in FIG. 6.

The inner surface 36 of the vessel 3 includes at least one basket retaining assembly 38 as is best seen in FIGS. 3 and 7. The basket retaining assembly 38 is formed from a pair of stainless steel dowels 42, 43 preferably one inch in diameter. In operation, one of the central plate pair ends 20*a*, 20*b* or 21*a*, 21*b*, is slid between the dowels 42, 43 of the basket retaining assembly 38 when the basket 11 is lowered within the interior of the vessel 3. The purpose of the basket retaining assembly 38 is to prevent the basket assembly 11 from rotating relative to the interior of the vessel 3 should the cask one be subjected to a spurious torque.

The outer surface of the vessel 3 is connected to the previously mentioned ribs 5. Specifically, the inner edges 47 of the carbon steel ribs 5 are connected to the low-alloy steel which forms the walls 4 of the vessel 3 by means of fillet welds 48 on either side of each rib 5. These fillet welds 48 not only provide a strong mechanical joint between the wall 4 of the vessel 3 and the inner edge 47 of the ribs 5; it also provides a thermally conductive bridge between the wall 4 and the ribs 5 which facilitate the conduction of heat from the inner surface 36 of the vessel 3 to its outer surface 45.

A layer high-hydrogen content cement 50 is applied over the outer surface 45 of the vessel 3 in between the ribs 5 as is best seen in FIG. 4A. The highhydrogen content in the cement layer 50 provides a high neutron cross section which renders the layers 7 particularly effective in absorbing neutron radiation. This is important, since the low-alloy steel which forms the wall 4 of the vessel 3 .is effective at attenuating gamma radiation, but not neutron radiation. Attached along the outer edges of each of the ribs 5 are the parallel edges 52*a*, 52*b* of the peripheral fins 9. As has been previously indicated, the mode of attachment between the outer edge 51 of the ribs 5 and the parallel edges 52*a*, 52*b* of the fins 9 are fillet welds 53, which are preferably continuous along the entire length of the edges 52*a*, 52*b*. The peripheral orientation of the fins 9 and their attachment to the outer edges 51 of the ribs 5 provides four distinct advantages. First, during the fabrication of the cask 1 the fins 9 may advantageously be used as forms which in effect mold the cementitious layer 7 in its proper position over the outside surface 45 of the vessel 3. Secondly, the point 0.25 inch thick fins 9 provide a formable mechanical barrier over the relatively brittle layer of cement 7 which protects it from fracturing or shattering in the event that the exterior of cask 1 is subjected to mechanical shock. Thirdly, these fins 9 provide a watertight barrier over the layer of cement 7 which renders the cask 1 immersible in a spent-fuel pool without any danger of dissolved radionucleide being soaked up in the porous and water-permeable cement layer 7. Finally, the peripheral fins 9 provide excellent heat dissipation in a structure which is considerably less fragile than radially-oriented heat dissipation fins.

With respect now to FIG. 4B, the exterior surfaces of each of the fins 9 is preferably provided with a coating 54 for both rendering the fins 9 corrosion-resistant, as well as for filling in the micropores which normally exist on the surface of carbon steel, thereby displacing a potential situs where radioactive dust or dissolved radionucleides could lodge into the surface of the fins 9. In the preferred embodiment, the coating 54 includes a first layer coating 55 of a zinc-containing primer, as well as a layer 56 of an epoxy polyamid intermediate build coat. A top coat 56 of polyester polyurethane provides the last of the three layers. In the preferred embodiment, the primer is preferably Carbo Zinc -8 manufactured by the Carboline Company located in St. Louis, Mo., while the intermediate outer layers 56 and 57 are preferably a Series 66 High-Build Epoxoline and a Series 70 and 71 Endura-Shield, both of which are manufactured by Tnemec Company, Inc., located in St. Louis, Mo.

Figure 5:
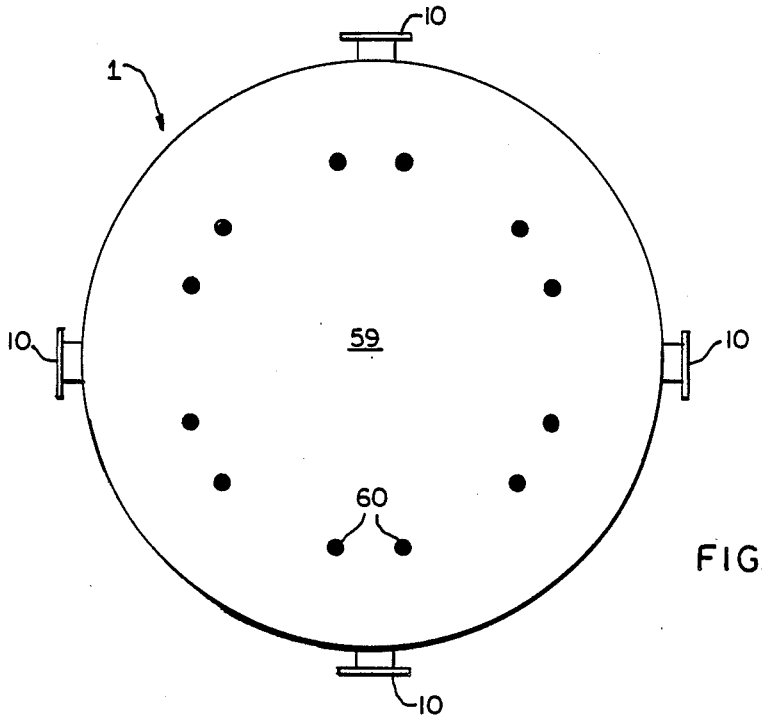
FIG. 5 is a plan view of the outer lid of the cask illustrated in FIG. 1 along the line 5—5.
Figure 6:
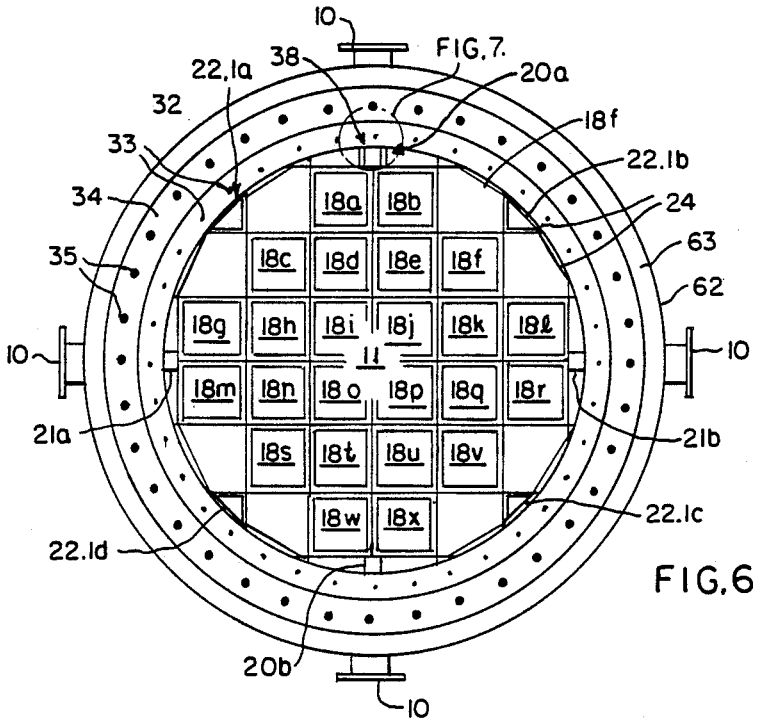
FIG. 6 is a plan view of the upper end of the cask illustrated in FIG. 1 along the line 6—6.

With reference now to FIGS. 3 and 5, a lid assembly 58 is provided for the cask 1 which includes a lid 59. Stud and nut assemblies 60 are provided on the upper surface of the lid 59 as shown in order to secure it in place over the open end 28 of the vessel 3. The lid assembly 58 further includes an upper ring 62 which circumscribes the upper end of the cask 1 as is best seen in FIG. 3. The outer edge of the lid 59 abuts the upper edge 63 of the ring 62 when the lid is secured in place over the cask. The lower edge 64 of the ring 62 is welded to the upper edges of the fins 9 to create both a strong mechanical and watertight joint therebetween.

Figure 8:
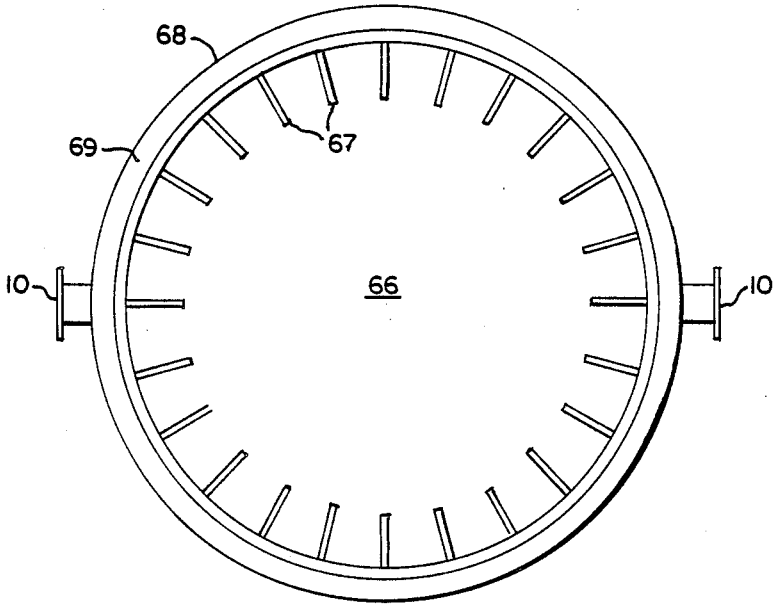
FIG. 8 is a plan view of the bottom end of the cask along illustrated in FIG. 1 along the line 8—8.

With reference now to FIGS. 3 and 8, the cask 1 also includes a floor assembly 65 which includes a disk 66 which sits at the bottom of the cask 1 as shown. A spoke assembly 67 is provided over the ground-engaging surface of the disk 66 to help even out the load that the cask 1 applies to the disk 66 when the cask 1 is stood upright on the ground in the position shown. The floor assembly 65 also includes a lower ring 68 which is similar in structure to the previously discussed upper ring 62. Ring 68 circumscribes the very bottom of the cask 1, and its bottom edge 69 is welded around the edge of the bottom disk 66 to form a strong, watertight connection therebetween. The upper edge of the ring 68 is likewise welded to the lower edges 70 of the fins 9 again to form a strong mechanical and watertight joint therebetween.

Figure 9D:
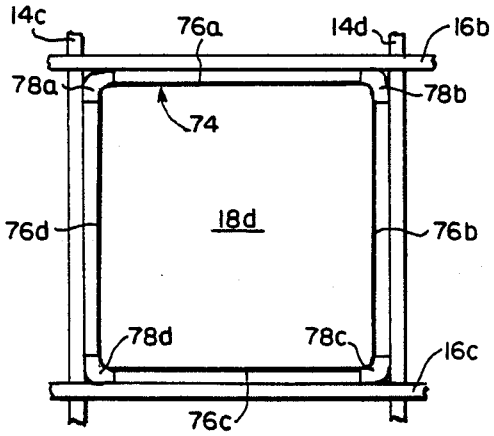
FIG. 9D is an enlarged view of the cell circled in FIG. 9B.

With reference now to FIGS. 9A, 9B and 9D each of the cells 18*a*–18*x* of the basket assembly 11 includes a container 74 adapted to contain spent fuel rods.

As is best seen in FIG. 9A, each of the containers 74 is circumscribed by a lead-in flange 75 to facilitate the insertion of fuel rods therein. As is best seen in FIG. 9D, each of the four walls of the containers 74 is lined, on its outer surface, with sheets 76*a*–76*d* of Boral ® or some other material having a high-neutron cross section. The provision of such neutron-absorbing sheets 76*a*–76*d* for "poison plates" as they are known in the art creates flux traps between adjacent cells 18*a*–18*x* which greatly attenuates the transmission of thermal neutrons between the various cells 18*a*–18*x* of the basket assembly 11. Finally, brackets 78*a*–78*d* are provided in the corners of each of the cells 18*a*–18*x* for securing the container 74 therein. In the preferred embodiment, each of the containers 74 is preferably fabricated from stainless steel sheet material in order to avoid corrosion.

We claim:

1. A shipping cask for transporting radioactive material, comprising:
   a. an inner vessel having a metallic, heat conducting wall;
   b. a plurality of heat conductive, mutually parallel ribs, each of which is substantially flat and has an inside and an outside edge, wherein the inside edge is connected to the outside surface of the heat conducting wall of the inner vessel, and wherein each rib is oriented substantially orthogonally with respect to said outside surface
   c. a layer of radiation absorbing, cementitious material disposed over the exterior of the heat conducting wall of the inner vessel and between the mutually parallel ribs, and
   d. a plurality of flat, circumferentially disposed fin members, each of which has two opposing and mutually parallel edges that are connected to the outer edges of two adjacent ribs for dissipating the heat conducted by the ribs, for supporting and protecting the layer of cementitious material, and for providing a watertight barrier over the layer of cementitious material, wherein the substantially orthogonal orientation of the ribs that support each fin member reinforces said fin member against mechanical shock applied to the cask.

2. The shipping cask defined in claim 1, wherein the inside edge of each rib is mechanically and thermally connected to the outside surface of the inner vessel by welds on either side of said inside edge.

3. The shipping cask defined in claim 2, further comprising a removable basket assembly for holding radioactive material that is insertable into and the withdrawable from the interior of the inner vessel wherein said basket assembly includes a plurality of substantially flat formers around its periphery for structurally reinforcing said basket assembly.

4. The shipping cask defined in claim 3, wherein said formers are spaced apart for conducting convective air currents between said basket assembly to the inside surface of said inner vessel.

5. The shipping cask defined in claim 2, wherein the periphery of the basket assembly includes a plurality of discrete contact surfaces for distributing forces that the basket assembly applies to the inside surface of the inner vessel.

6. The shipping cask defined in claim 5, wherein the discrete contact surfaces are substantially uniformly spaced around said periphery so that the distribution of said forces is substantially uniform.

7. The shipping cask defined in claim 3, wherein said basket assembly includes a cell structure that terminates in a plurality of corners around its periphery, and wherein said formers each include a plurality of strut plates, each of which is connected across two adjacent corners of said cell structure.

8. The shipping cask defined in claim 3, wherein said basket assembly includes a cell structure formed from a plurality of interconnected plates that terminate in opposing, parallel edges, and wherein said inner vessel includes a plate retainer means for receiving and retaining the edges of at least one of the plates of the cell structure.

9. The shipping cask defined in claim 8, wherein the plate retainer means includes a pair of parallel dowel members, each of which includes an end that is connected to the inside surface of the inner vessel.

10. The shipping cask defined in claim 1, wherein said ribs and flat fin members are all fabricated from substantially the same type of metal to facilitate the creation of weld joints therebetween.

11. A shipping cask for transporting radioactive material, comprising:

a. an inner vessel having an open end, a closed end and a heat conducting wall formed from an alloy containing iron;

b. a plurality of substantially flat, heat conductive and mutually parallel ribs formed from an alloy containing iron, each of which has an inside and an outside edge, wherein the inside edge is welded to the outside surface of the heat conducting wall of the inner vessel by welds on either side of said inside edge, and wherein each rib is oriented substantially orthogonally with respect to said outside surface;

c. a layer of neutron absorbing, cementitious material disposed over the outside wall of the inner vessel and between the mutually parallel ribs, and d. a plurality of flat fin members formed from an alloy containing iron, each of which has two opposing and mutually parallel edges that are connected to the outer edges of two adjacent ribs for both dissipating heat conducted by the ribs, for supporting and protecting the layer of cementitious material and creating a watertight barrier between the cask exterior and the cementitious material, wherein the substantially orthogonal orientation of the ribs that support each fin member reinforces said fin member against mechanical shock applied to the cask.

12. The shipping cask defined in claim 11, wherein said edges of said flat fin members are welded along their lengths to the outer edges of said ribs to create a watertight connection between said fin members and said ribs.

13. The shipping cask defined in claim 11, wherein said inner vessel is formed from low alloy steel, and said ribs and flat fin members are formed from carbon alloy steel.

14. The shipping cask defined in claim 11, wherein the outer surface of the fins includes an anti-corrosive coating for both inhibiting corrosion and for filling in the pores of the metal forming the fins to prevent the lodgment of radioactive dust therein.

15. The shipping cask defined in claim 14, wherein said coating includes a first layer of a zinc-containing primer, a second layer of epoxy polyamide, and a third layer of polyester polyurethane.

16. The shipping cask defined in claim 11, wherein said fins each further include bottom edges, and wherein said cask further includes a floor assembly having an upper edge that is sealingly connected to the bottom edges of the fins.

17. The shipping cask defined in claim 16, wherein the floor assembly includes an end plate that covers the closed end of the inner vessel.

18. The shipping cask defined in claim 11, wherein said fins each further include top edges, and wherein said cask includes a lid assembly having a lower edge that is sealingly connected to the top edges of the fins.

19. The shipping cask defined in claim 18, wherein said closure assembly includes a lid ring having a lower edge that is welded to the top edges of the fins, and a lid means that is sealingly and detachably connectable to an upper edge of said ring.

20. The shipping cask defined in claim 11, further comprising a removable basket assembly having a cell structure for containing radioactive material, wherein the outside of the basket assembly is closely dimensioned to the inside surface of the inner vessel, said basket assembly further including a plurality of flat, angular formers around its periphery for structural reinforcement, said formers being uniformly spaced apart from one another and covering no more than about 30 percent of the outer surface of the basket assembly so as to freely conduct heat in convective and radiative form from said basket assembly to the interior surface of the inner vessel.

21. The shipping cask defined in claim 11, further comprising a removable basket assembly having a cell structure that terminates in corners around the periphery of the basket assembly.

22. The shipping cask defined in claim 21, wherein said basket assembly includes formers around its periphery for increasing the ability of the cell structure to resist deformation if subjected to mechanical shock, wherein said formers each include a plurality of strut plates having opposing edges that are connected to adjacent corners of the cell structure, respectively.

23. The shipping cask defined in claim 21, wherein said corners form discrete contact surfaces between the basket assembly and the inside surface of the inner vessel.

24. The shipping cask defined in claim 23, wherein the discrete contact surfaces are substantially uniformly spaced around said periphery so that the distribution of said forces is substantially uniform.

25. A shipping cask for transporting radioactive material, comprising:

a. a cylindrical, heat conductive inner vessel having an open end, a closed end, and a side Wall formed from low alloy steel;

b. a plurality of heat conductive, mutually parallel ribs formed from carbon steel, each of which has an inside and an outside edge, the inside edges being welded to the outside surface of the side wall of the inner vessel;

c. a layer of neutron-absorbing, cementitious material disposed over the outside of the inner vessel and between the mutually parallel ribs;

d. a plurality of flat fin members formed from carbon steel, each of which has two opposing and mutually parallel edges that are connected to the outer edges of two adjacent ribs for both dissipating heat conducted by the ribs, for supporting the layer of cementitious material and creating a watertight barrier over the outside surface of the material, and e. a basket assembly insertable into and withdrawable from the interior of the inner vessel, the outer surface of the basket assembly being closely dimensioned to the interior of the vessel, wherein said basket assembly is circumscribed by a plurality of flat, angular formers for structural reinforcement, said formers being uniformly spaced from one another and covering no more than about 25 percent of the outer surface of the basket assembly to allow the convective and radiative transmission of heat from the inside surface of the vessel.

* * * * *